US009874389B2

(12) United States Patent
Thorman

(10) Patent No.: US 9,874,389 B2
(45) Date of Patent: Jan. 23, 2018

(54) DISPENSING OF FOOD AND BEVERAGE PRODUCTS

(71) Applicant: Mondelez UK R & D Limited, Birmingham (GB)

(72) Inventor: William Thorman, Birmingham (GB)

(73) Assignee: Mondelez UK R&D Limited, Bournville (GB)

( * ) Notice: Subject to any disclaimer, the term of this patent is extended or adjusted under 35 U.S.C. 154(b) by 0 days.

(21) Appl. No.: 14/423,993

(22) PCT Filed: Aug. 6, 2013

(86) PCT No.: PCT/GB2013/052100
§ 371 (c)(1),
(2) Date: Feb. 25, 2015

(87) PCT Pub. No.: WO2014/033431
PCT Pub. Date: Mar. 6, 2014

(65) Prior Publication Data

US 2015/0250331 A1 Sep. 10, 2015

(30) Foreign Application Priority Data

Aug. 30, 2012 (GB) ..... 1215459.7

(51) Int. Cl.
*A47F 3/04* (2006.01)
*F25D 7/00* (2006.01)
(Continued)

(52) U.S. Cl.
CPC ..... *F25D 7/00* (2013.01); *A47F 1/06* (2013.01); *A47F 3/0408* (2013.01);
(Continued)

(58) Field of Classification Search
CPC ..... B65D 77/04; G07F 9/105; G07F 9/10
(Continued)

(56) References Cited

U.S. PATENT DOCUMENTS 1,692,062 A 11/1928 Tobin
1,935,424 A 11/1933 Wichmann
(Continued)

FOREIGN PATENT DOCUMENTS

CN 1144902 A 3/1997
DE 20007266 U1 8/2000
(Continued)

OTHER PUBLICATIONS

International Search Report, dated May 11, 2013 for PCT/GB2013/052100 (4 pgs.).
(Continued)

*Primary Examiner* — Gene Crawford
*Assistant Examiner* — Ayodeji Ojofeitimi
(74) *Attorney, Agent, or Firm* — Fitch, Even, Tabin & Flannery LLP

(57) ABSTRACT

A cooler cabinet comprises: a storage compartment (130) for food or beverage products (130); a dispensing mechanism (143) for dispensing the food or beverage products (144) from the storage compartment without opening the storage compartment to ambient air; a water-retaining material (120) outside the storage compartment but in contact with it; an air channel (111) in contact with the water-retaining material; and means (114) for moving air through the air channel such that the air increases the rate of evaporation of water from the water-retaining material. It thereby withdraws heat from the water-retaining material and causes cooling of the interior of the cabinet, including the food or beverage products.

17 Claims, 3 Drawing Sheets

(51) Int. Cl.
*F25D 25/04* (2006.01)
*A47F 1/06* (2006.01)

(52) U.S. Cl.
CPC ..... *A47F 3/0426* (2013.01); *F25D 25/04* (2013.01); *F25D 2331/806* (2013.01)

(58) Field of Classification Search
USPC ..... 221/150 R, 150 HC
See application file for complete search history.

(56) References Cited

U.S. PATENT DOCUMENTS

| | | | | |
|---|---|---|---|---|
| 1,972,800 | A | 9/1934 | Shelor | |
| 2,706,385 | A | 4/1955 | Topping | |
| 3,529,437 | A | 9/1970 | Bell | |
| 4,350,271 | A * | 9/1982 | Eckenhoff | A61M 31/002 222/386.5 |
| 4,823,984 | A * | 4/1989 | Ficken | F25D 19/00 221/126 |
| 4,977,754 | A * | 12/1990 | Upton | A47F 3/0408 221/150 R |
| 5,701,756 | A | 12/1997 | Ghiraldi | |
| 6,085,534 | A * | 7/2000 | Anthony | F25D 3/105 221/150 R |
| 6,286,710 | B1 * | 9/2001 | Paek | G07F 5/18 221/124 |
| 6,808,083 | B2 * | 10/2004 | Roekens | G07F 9/105 221/150 HC |
| 6,945,070 | B1 * | 9/2005 | Jablonski | B67D 1/0057 62/390 |
| 8,347,781 | B2 * | 1/2013 | Stack | A47G 19/26 220/203.01 |
| 2001/0022307 | A1 * | 9/2001 | Kamimura | G07F 9/105 221/150 HC |
| 2009/0090734 | A1 * | 4/2009 | Wittern, Jr. | F25D 17/065 221/1 |
| 2014/0061221 | A1 * | 3/2014 | Chao | G07F 9/105 221/150 R |

FOREIGN PATENT DOCUMENTS

| | | | |
|---|---|---|---|
| DE | 202010007381 | U1 | 8/2010 |
| EP | 1055889 | A2 | 11/2000 |
| GB | 421974 | A | 12/1934 |
| JP | H07187250 | A | 7/1995 |
| JP | H08285423 | A | 11/1996 |
| JP | 11309076 | A | 11/1999 |
| JP | 2004264007 | A | 9/2004 |
| JP | 2005027812 | A | 2/2005 |

OTHER PUBLICATIONS

UK Intellectual Property Office Search Report dated Dec. 11, 2012 for Application No. 1215459.7 (4 pgs.).

Written Opinion of the International Searching Authority for International Application No. PCT/GB2013/052100 (8 pgs.).

English translation of Notice of Reasons for Rejection, dated Jan. 8, 2016 for Japanese Patent Application No. 2015-527021 (6 pgs.).

Notification of the First Office Action, dated Jan. 28, 2016 for Chinese Patent Application No. 201380045123.0 with English translation (14 pgs.)

Response to May 4, 2015 Communication pursuant to Rules 161(1) and 162 EPC, dated Jun. 16, 2015 for European Patent Application No. 13750103.7 (7 pgs.).

* cited by examiner

DISPENSING OF FOOD AND BEVERAGE PRODUCTS

CROSS REFERENCE TO RELATED APPLICATIONS

This application is a U.S. national phase application of International Application No. PCT/GB2013/052100, filed Aug. 6, 2013, which claims benefit from Great Britain Application 1215459.7, filed Aug. 30, 2012, which are hereby incorporated herein by reference in their entirety.

FIELD

The present invention relates to a cooler cabinet for storing and dispensing food and beverage products and to a method of cooling and dispensing a food or beverage product.

BACKGROUND

Certain food and beverage products are desirably stored and dispensed to a customer at a temperature lower than the ambient temperature; for example chocolate or soft drinks. Typically such products are stored in a refrigerated cabinet until a product is required by a consumer. Known cabinets for cooling, storing and dispensing such products are provided with a refrigerator unit powered by mains electricity to cool the products within the cabinet.

Certain refrigerated cabinets are provided with a coin-operated dispensing mechanism which when actuated dispenses a product to the exterior of the cabinet.

Refrigerated cabinets as described above are expensive, and are commonly large and heavy and therefore not easily transportable. Also such refrigerated cabinets may not be suitable for use at locations where mains electricity is not readily available. Maintenance and repair of such refrigerated cabinets often requires skilled engineers and the disposal of worn-out refrigerator units must be carefully controlled in order to prevent the release of environmentally harmful refrigerant gases.

SUMMARY

According to the first aspect of the present invention there is provided a cooler cabinet comprising: a storage compartment for food or beverage products; a dispensing mechanism for dispensing the food or beverage products from the storage compartment without opening the storage compartment to ambient air; a water-retaining material outside the storage compartment but in contact with it; an air channel in contact with the water-retaining material; and means for moving air through the air channel such that the air withdraws heat from the water-retaining material.

The storage compartment may be suitable to contain a plurality of food or beverage products. In some embodiments the storage compartment may be suitable to contain a plurality of food products, for example food products comprising chocolate. In alternative embodiments the storage compartment may be adapted to contain a plurality of beverage products, for example beverage products selected from fruit juices, milk, carbonated beverages, beer and water. The size of the storage compartment is such as to hold a plurality of products. Suitably the storage compartment is substantially cuboid in shape.

Suitably the storage compartment comprises a main body and a lid. Suitably the main body is constructed from a thermally conductive material. Suitable thermally conductive materials include metals, for example stainless steel, aluminium and copper.

Suitably the lid may be moved between a closed position and an open position; for example a removed or displaced position. The lid enables an operator to insert or remove food or beverage products. The lid when closed may form a substantially air-tight seal with the main body of the storage compartment. Suitably when the lid is closed it substantially prevents ambient air from entering the storage compartment.

The storage compartment may have an upper face, a lower face and one or more side faces. When there is only one side face it may for be cylindrical, for example circularly cylindrical or ovally cylindrical, or it may have a plurality of side faces, for example four side faces. Suitably the lid forms the upper face of the storage compartment.

In some embodiments at least a part of the lid is constructed from a transparent material. In other embodiments substantially the entire lid is constructed from a transparent material. Suitable transparent materials include glass and polymer materials. Suitable polymer materials include poly (methylmethacrylate) and polycarbonate. Suitably at least a part of the inside of the storage compartment is viewable from outside the storage compartment. When the storage compartment comprises one or more food or beverage products then at least part of one of the food or beverage products may be viewable from the exterior of the storage compartment.

Suitably the lid is provided with means to retard heat transfer from the exterior of the storage compartment to the interior of the storage compartment. Such means may be provided on transparent parts of the lid and/or on non-transparent parts of the lid. Suitably the lid is constructed from two layers of material separated by a void. The void may be filled with air, be substantially evacuated of air or be filled with insulating material. Suitable insulating material includes polymer foam, fibre glass, mineral wool and natural wool. Suitably the transparent parts of the lid are double-glazed. Suitable double-glazing comprises two layers of transparent material separated by a void. The void may be filled with air or may be substantially evacuated of air. In some embodiments the double-glazing may be at least partially non-transparent, for example at least part of the glazing may be tinted or covered by an opaque layer. Suitable opaque layers include a polymer sheet covering, a metal sheet covering and paint. Non-transparent parts of the lid may be constructed from a single layer of material and provided with insulation. Suitable insulation for the non-transparent parts of the lid includes polymer foam, fibre glass, mineral wool and natural wool.

It is undesirable to open the lid other than for restocking, as cooled air will escape. Accordingly the lid may be fitted with a lock such that the storage compartment can be locked by an operator to prevent another person from accessing the storage compartment. Alternatively a catch, or a written request or warning, may be enough to deter customers from unauthorised opening of the lid.

The cooler cabinet comprises a dispensing mechanism for dispensing the food or beverage product without opening the storage compartment to ambient air. Suitably the cooler cabinet also comprises a dispensing hatch adjacent to the dispensing mechanism through which a food or beverage product may be removed from the storage compartment. A suitable dispensing mechanism may progressively advance food or beverage products contained within the storage compartment towards the exterior of the storage compartment such that the food or beverage product remains substantially sealed from the exterior of the storage compartment until it emerges from the inside of the storage compartment. Suitably the dispensing mechanism is actuated by a user to expel a food or beverage product from the storage compartment and advance a series of remaining food or beverage products towards the exterior of the storage compartment.

Suitable dispensing mechanisms include rotary dispensing mechanisms. A suitable rotary dispensing mechanism may comprise a wheel fitted with paddles. The recesses between adjacent paddles are suitable for receiving a food or beverage product and advancing the food or beverage product when the wheel is rotated. Suitably the rotary dispensing mechanism is positioned on or adjacent to a surface of the storage compartment such that the recesses are exposed to the exterior of the storage compartment through the dispensing hatch in turn through the rotation of the rotary dispensing mechanism. A thumbwheel may be provided to facilitate operation.

Suitably the paddles of the dispensing mechanism provide a substantially air-tight seal with the housing and the dispensing hatch such that a substantially air-tight seal of the storage compartment may be maintained during a dispensing action. It will be appreciated that the rotary dispensing mechanism through its normal operation will inevitably cause air from the exterior of the storage compartment to be moved into the storage compartment as paddles rotate from the exterior of the storage compartment into the storage compartment. However, the ingress of ambient air into the storage compartment is suitably minimized by the dispensing mechanism.

The storage compartment may comprise a means for advancing the food or beverage products into the dispensing mechanism such that when the dispensing mechanism is actuated to remove a food or beverage product from the storage compartment the food or beverage products remaining in the storage compartment are advanced towards the dispensing mechanism. Suitable means for urging the food or beverage products into the dispensing mechanism may comprise mechanical apparatus, for example a spring and a plate wherein the spring may force the plate against the food or beverage products, and so urge the products towards the dispending mechanism. In alternative embodiments wherein the lower surface of the storage compartment is sloped downwards towards the dispensing mechanism, the food or beverage products may be advanced into the dispensing mechanism by gravity.

In some embodiments the means for advancing the food or beverage products into the dispensing mechanism may comprise a conveyor for retaining food or beverage products and advancing them towards the dispensing mechanism. A suitable conveyor may be a belt or a track. The conveyor may have defined sections for receiving the food or beverage products. The conveyor may be coupled to the dispensing mechanism such that the conveyor is actuated when the dispensing mechanism is actuated thereby moving food or beverage products into the dispensing mechanism as food or beverage products are dispensed.

The cooler cabinet comprises a water-retaining material outside the storage compartment but in contact with it. The water-retaining material and the storage compartment are suitably arranged to allow the storage compartment and the air within it to be cooled as a result of water evaporating from the water-retaining material. The evaporation of water requires energy in order to undergo the phase change from a liquid to a gas. This energy is known as the latent heat of vaporisation or the enthalpy of vaporisation and is provided by the body of water. Therefore the evaporating water withdraws heat energy from the body of water and lowers the temperature of the remaining water with respect to the temperature of the body of water before the evaporation. As water vapour leaves the cabinet and further evaporation of water as vapour from the water-retaining material occurs, there is a continuing net cooling effect on the water-retaining material. As the water-retaining material cools, this cooling effect is conveyed to the storage compartment primarily by conduction.

The water-retaining material could be supplied with replacement water by the operator, pouring water onto it. Alternatively the cabinet may have a water tank with the operator refills as required, and which keeps the water-retaining material moist. This may happen by way of an on-demand water feed arrangement whereby water is drawn from the tank when the water-retaining material becomes dry. This may, for example, employ a suitable membrane between the tank and the water-retaining material.

Suitable water-retaining materials include water-absorbent fibrous material and water-absorbent polymers. Suitable water-absorbent fibrous materials may be natural fibrous materials or man-made fibrous material. Suitable water-absorbent natural fibrous materials include cotton, cellulose, hemp, and paper. Suitable water-absorbent man-made fibrous materials include polymer sponges. In some embodiments the water-retaining material comprises water-absorbent polymers. Suitable water-absorbent polymers include polyacrylic acid sodium salts, polyacrylamide copolymer, ethylene maleic anhydride copolymer, cross-linked carboxymethylcellulose, polyvinyl alcohol copolymers, cross-linked polyethylene oxide, and starch grafted copolymer of polyacrylonitrile. Suitably the water-absorbent polymers form a gel when mixed with water.

Suitably the water-retaining material is in contact with at least a part of an outer surface of the storage compartment. In embodiments where the storage compartment has an upper face, a lower face and at least one side face, the water-retaining material may be in contact with at least a part of the lower face of the storage compartment. Suitably the water-retaining material is in contact with substantially all of the lower face of the storage compartment. Suitably the water-retaining material is in contact with substantially all of the lower face of the storage compartment and at least a part of at least one side face of the storage compartment. In some embodiments the water-retaining material is in contact with substantially all of the lower face of the storage compartment and at least a part of each side face of the storage compartment. Suitably the storage compartment comprises an upper face, a lower face and four side faces. In some embodiments the water-retaining material is in contact with substantially all of the lower face of the storage compartment and substantially all of each of the four side faces of the storage compartment.

Suitably the water-retaining material is held in contact with the storage compartment by a support structure. Suitably the support structure allows air and water vapor to pass through it to and from the water-retaining material. Suitably the support structure allows air, water vapor and water to pass through it to and from the water-retaining material. Suitably the support structure comprises a stainless steel mesh. The water-retaining material could be placed directly on the mesh or on a textile liner, for example of a non-woven material, or a paper or card liner. The water-absorbing material could comprise gel granules when the mesh is fine and/or when a liner is used.

The mesh may be non-planar, for example corrugated, in order to increase the surface area thus increasing evaporation, and hence boost the cooling effect.

The cooler cabinet comprises an air channel in contact with the water-retaining material. In embodiments wherein the water-retaining material is held in contact with the storage compartment by a support structure, the air channel may be in contact with the water-retaining material through the support structure. Suitably the air channel is in contact with at least a part of the support structure of the water-retaining material. In some embodiments the air channel is in contact with substantially all of the support structure of the water-retaining material. Suitably the air channel is enclosed by the support structure of the water-retaining material and an outer casing of the cooler cabinet. Suitable materials for the construction of the outer casing include polymers and metals. Glass-fibre reinforced plastics materials are especially suitable.

Suitably the storage compartment has an upper, outwardly-extending flange which rests on an upper, outwardly extending flange of the outer casing, whereby the storage compartment is suspended in the outer casing.

The cabinet may be styled to connote products to be dispensed from it. For example it may have colour(s) and/or shape redolent of the product and/or its packaging.

The cabinet could be designed to progressively dispense one product, from one array of the products. Alternatively it could dispense more than one product, from parallel arrays of those products. Suitably each product will have its own conveying means and dispensing means so that one product can be taken without another product, or products being taken.

In some embodiments the outer casing forms the base of the cooler cabinet. Suitably the outer casing comprises the air channel which is above the base of the cooler cabinet. Suitably the water-retaining material is held by the support structure above the base and within the air channel, for example the water-retaining material is at least partially embraced by the air channel. The water-retaining material may be embraced by the air channel on substantially all of a lower face of the water-retaining material and at least part of at least one side face of the water-retaining material. Suitably the storage compartment is located above the base of the cooler cabinet and within the water-retaining material, for example the storage compartment is at least partially embraced by the water-retaining material. The storage compartment may be embraced by the water-retaining material on substantially all of a lower face of the storage compartment and at least part of at least one side face of the storage compartment.

Suitably the air channel comprises at least two openings, which may comprise an air inlet and an air outlet. The at least two openings may be arranged at opposite ends of the air channel.

The cooler cabinet comprises means for moving air through the air channel such that the air may withdraw heat from the water-retaining material. The means for moving air through the air channel may be arranged at one of the at least two openings of the air channel. Suitably the means for moving air through the air channel may be arranged between the at least two openings of the air channel. Suitable means for moving air through the air channel include a fan and a compressor. A water battery could use water (or alternative aqueous solution) in the tank described above as its electrolyte. Suitable fans include an axial propeller fan, a centrifugal propeller fan, and a crossflow fan. The means for moving air through the air channel may be powered by a suitable power source. Suitable power sources include photovoltaic cells, electric batteries, mains electricity and mechanical actuation by an operator. Suitable electric batteries include rechargeable and non-rechargeable electric batteries. In suitable embodiments the cooler cabinet is powered by a photovoltaic cell and a rechargeable electric battery. Suitably the means for moving air through the air channel can be operated without a mains electricity supply. Moving air through the air channel is intended to facilitate the evaporation of water from the water-retaining material and so produce a cooling effect on the water-retaining material. The cooling effect is conveyed to the storage compartment which is in contact with the water-retaining material.

The air channel could contain a flow restriction, such as a ramp or baffle, in a region where enhanced cooling is wanted. For example this may be desirable adjacent to the dispensing region. The restriction will cause higher air flow rate, enhanced evaporation, and hence enhanced heat withdrawal from the water-retaining material. Additionally Peltier-effect cooling could be used to increase the cooling effect.

In some embodiments the cooler cabinet is light in weight and portable compared to known cooler cabinets. Suitably the cooler cabinet of the present invention has a low power consumption compared to know cooler cabinets. Suitably the cooler cabinet can be powered by a photovoltaic cell (e.g. a solar cell or small panel). In some embodiments the cooler cabinet can employ an electric battery as the power source or a cell charged by a photovoltaic cell.

According to a second aspect of the present invention there is provided a method of storing, cooling and dispensing a food or beverage product comprising the steps of:

(a) placing at least one food or beverage product in a storage compartment wherein the storage compartment is in contact with a water retaining material comprising water;

(b) moving air across the water-retaining material such that water vapor may evaporate from the water-retaining material; and (c) dispensing the food or beverage product from the storage compartment such that the interior of the storage compartment is not exposed to ambient air.

A cooler cabinet according to the first aspect of the present invention may be used to carry out the method of this second aspect.

Step (a) involves placing at least one food or beverage product in a storage compartment. The food or beverage product may be at ambient temperature when it is placed in the storage compartment. Suitably the food or beverage product has a temperature below ambient temperature when it is placed in the storage compartment. Suitably more than one food or beverage product is placed in the storage compartment. Suitably more than one food or beverage product having a temperature below ambient temperature is placed in the storage compartment. Suitably the storage compartment is substantially filled with food or beverage products having a temperature less than ambient temperature.

Step (b) involves moving air across the water-retaining material such that water vapor may evaporate from the water-retaining material. The suitable means for moving air referred to in relation to the first aspect may also be suitable for this second aspect. The means for moving air and the water-retaining material may be adapted to provide sufficient cooling to the storage compartment to maintain the temperature of the food or beverage products having a temperature below ambient temperature. In alternative embodiments the means for moving air and the water-retaining material may be adapted to provide sufficient cooling to lower the temperature of the food or beverage products.

Step (c) involves dispensing the food or beverage product from the storage compartment such that the interior of the storage compartment is not exposed to ambient air. Suitable means for dispensing the food or beverage product referred to in relation to the first aspect may also be suitable for this second aspect. The food or beverage products may be arranged in the storage compartment in a row such that the food or beverage products in the row may be dispensed from the storage compartment in turn.

BRIEF DESCRIPTION OF THE DRAWINGS

For a better understanding of the invention, and to show how embodiments of the same may be carried into effect, reference will now be made, by way of example, to the accompanying diagrammatic drawings in which.

DETAILED DESCRIPTION

Figure 1:
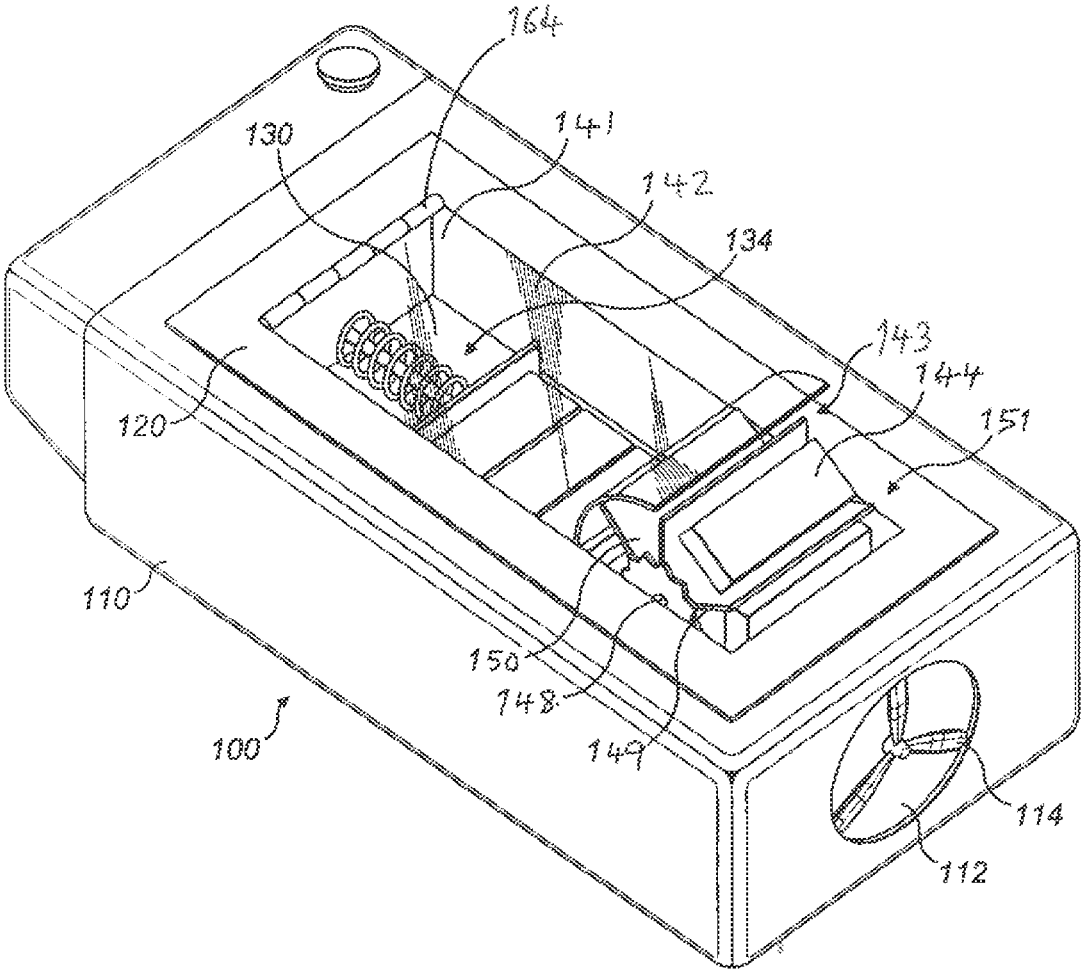
FIG. 1 is a perspective view of a cooler cabinet according to the present invention.
Figure 2:
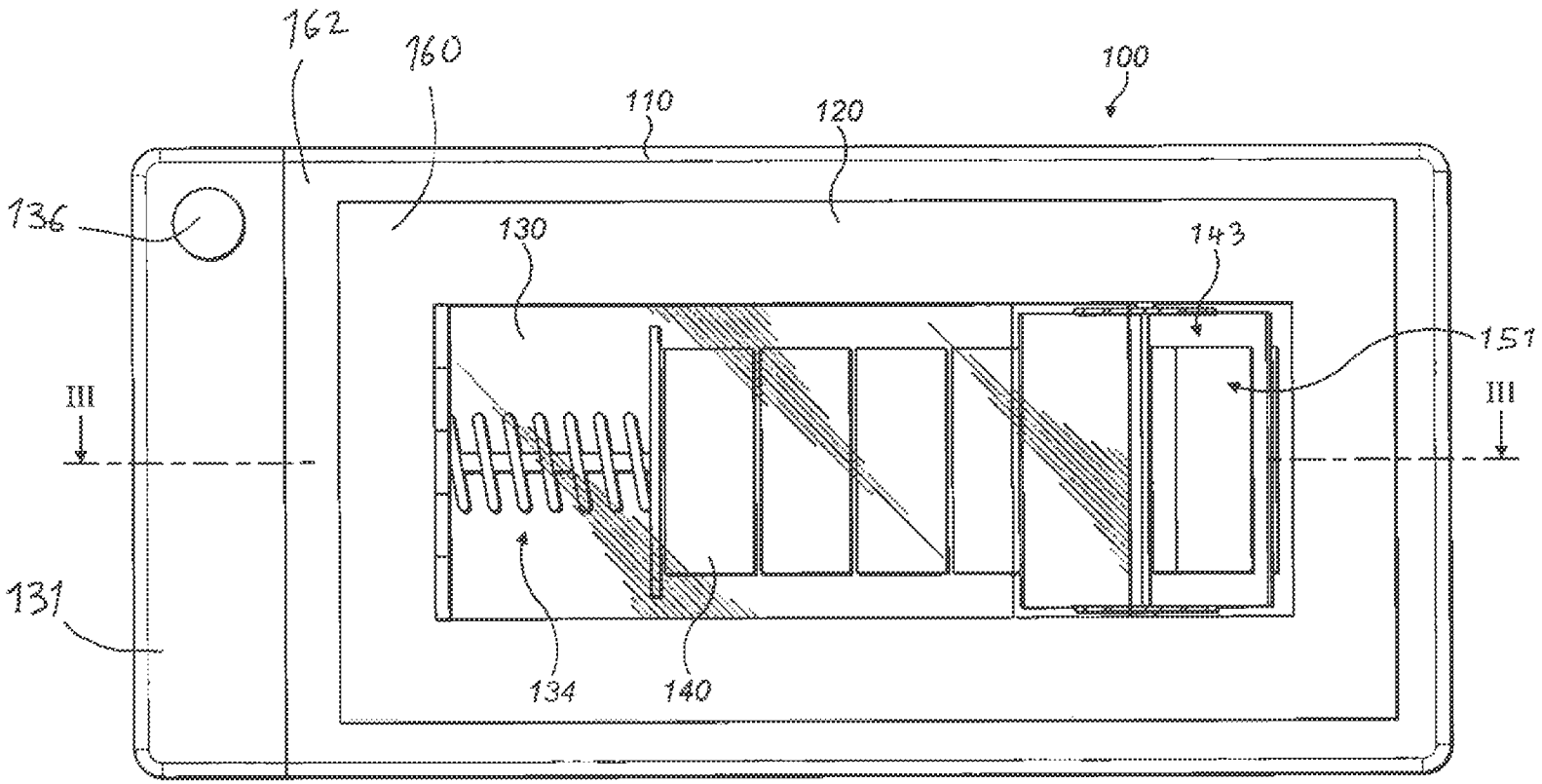
FIG. 2 is a plan view of the cooler cabinet of FIG. 1.
Figure 3:
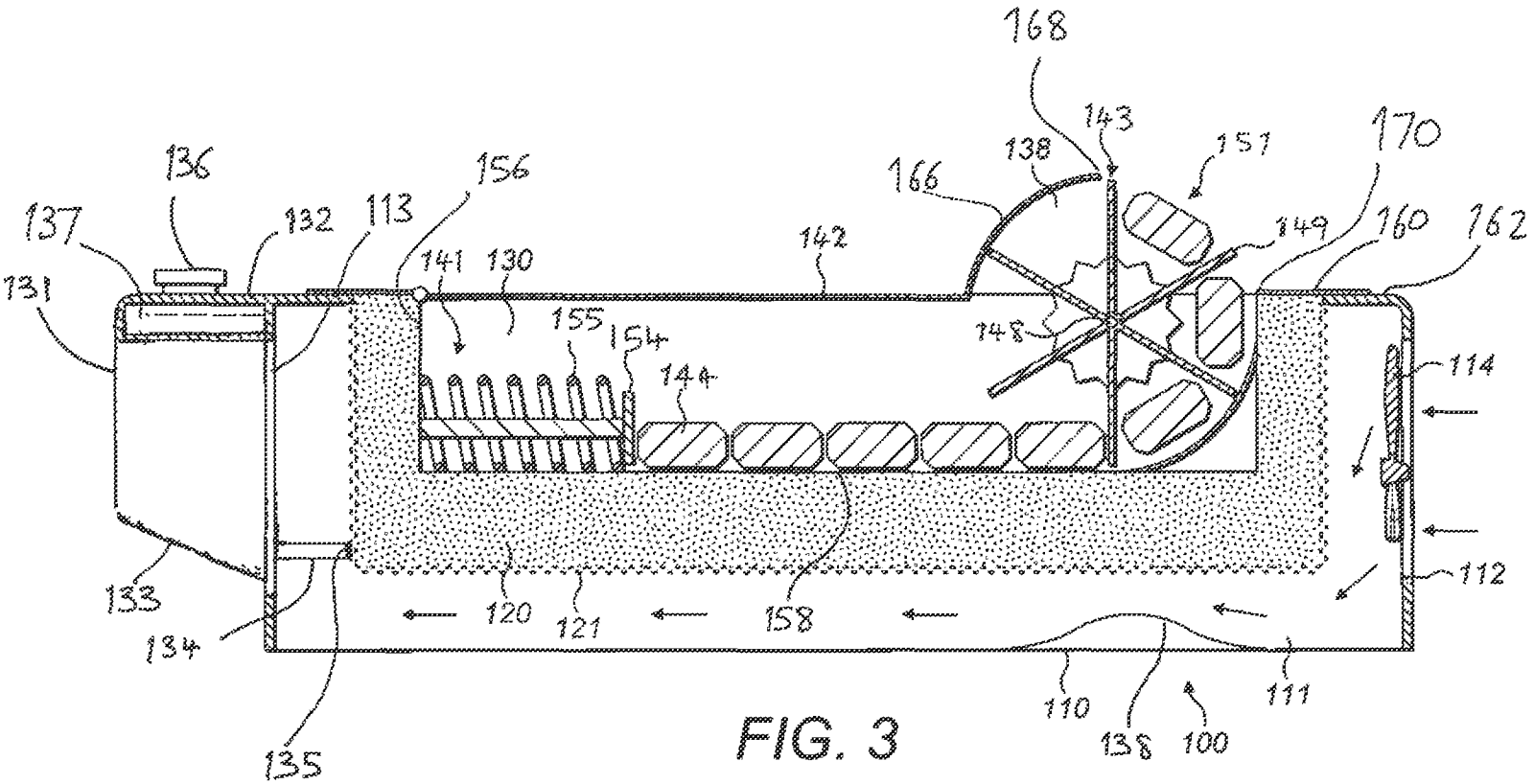
FIG. 3 is a cross-section view of the cooler cabinet along line III of FIG. 2.

The cooler cabinet (100) shown in FIGS. 1 to 3 comprises an outer casing (110) and, within the outer casing (110), a storage compartment (130). There is a space between the outer casing (110) and the storage compartment (130) (evident in FIG. 3) and in this space a water retaining material (120) is provided. The outer casing (110) is constructed from a plastics material such as glass-reinforced plastic. and as shown in FIG. 3, comprises an air channel (111), air inlet (112) and air outlet (113) and a fan (114) mounted at the air inlet (112). The water-retaining material (120) is a water-absorbing acrylic fibre mass which is supported by a mesh support structure (121) suspended within the outer casing and holding the water-retaining material. Thus the water-retaining material (120) is located between the mesh and the storage compartment (130). The mesh is sufficiently porous to allow water vapour from the water-retaining material to pass through the mesh support structure into the air channel. The mesh is somewhat corrugated to promote heat exchange.

At the end of the cabinet, external to the storage compartment, is a water chamber (131). The water chamber is of the same width as the cooler cabinet but is of lesser depth. It is of inverted U-shape or horseshoe-shape, being shaped so as not to obstruct the outlet (113). The top wall (132) is at the same level as the top wall of the cabinet but its bottom wall (133), which is bifurcated, and which is inclined towards two outlet pipes (134), one of which is in each bifurcation, are just above the level of the base of the mesh (121). One such pipe can be seen in FIG. 3. The two pipes supply water to respective side regions of the water-retaining material, at a low level thereof. The outlet end of each pipe (134) has a membrane (135) which allows water to pass only when the water-retaining material is not saturated. At the top of the tank is a filler cap (136). The top region (137) of the tank leads to both of the bifurcated regions, to each side of the outlet (113).

In use the water-retaining material (120) is loaded with water. The fan (114) is actuated by a power source (not shown) such that air is drawn into the air channel (111), through air inlet (112) and out of the air channel at air outlet (113). The power source may for example comprise a photovoltaic (solar) cell and/or a rechargeable electric battery. The air moving through the air channel (represented in FIG. 3 by the arrows within the air channel (111)) causes water to evaporate from the surface of the water-retaining material through the mesh support structure (121) and this water vapour is carried out of the air channel through air outlet (113). The evaporation of water from the water-retaining material causes the water-retaining material to cool. Removing the vaporised water from the cabinet by moving air through the air channel induces more water to evaporate into the air channel and therefore provides a continuous cooling effect on the water-retaining material. As the water-retaining material is in contact with the storage compartment (130), the cooling of the water-retaining material causes a cooling of the storage compartment and any food or beverage products contained within it.

The channel (111) is restricted specifically beneath the dispensing region (which will be described below). This is achieved by means of a ramp (138) which extends across the entire channel. The resulting restriction of the channel causes a higher air speed, and enhanced cooling, in that region.

The storage compartment (130) comprises a main body (141), a transparent lid (142), a dispensing mechanism (143), a means for advancing the food or beverage products (144) and a seal (not visible) around the edge of the lid. The main body comprises an upwardly open, cuboid, void formed by four side walls (156) and a bottom wall (158). The void contains the advancing means (154, 155), the products to be dispensed and the dispensing mechanism (143) and is covered, when the cabinet is in its dispensing mode, by the lid (142). Each side wall has at its top edge an outwardly directed flange (160). These rest on inwardly directed flanges (162 extending from the side walls of the outer casing thereby suspending the storage compartment in the outer casing. The water-retaining material is covered by the flanges. The arrangement can be seen more clearly in FIG. 3.

The lid is hinged (164) at its distal end. It is mainly flat, but at its proximal end (the dispensing end) has an arcuate region (106), around a region of the dispensing wheel. The dispensing hatch (151) is between the proximal end (168) of the lid and the front edge (170) of the storage compartment (130). The main body (141) is constructed from stainless steel. The transparent lid (142) is a double-glazed panel comprising a vacuum between two layers of glass or plastic material. The dispensing mechanism (143) is a rotary dispensing mechanism comprising a paddle-type dispensing wheel mounted for rotation about an axle (148), blades (149), recesses (150) between the blades for receiving food or beverage products and a dispensing hatch (151). It has on each side thumbwheels (152). The means for advancing the food or beverage products (144) comprises a plate (154) and spring (155).

In preparation for the dispensing operation the lid (142) is opened by a store operative and food or beverage products (144) are loaded transversely into the storage compartment, between the dispensing mechanism (143) and the means for advancing the food or beverage products (144), as a stack. The lid is then closed to form a substantially air-tight seal. The dispensing mechanism (143) is then actuated by a customer, using one of the thumbwheels to rotate sufficiently to engage food or beverage products and advance them towards the dispensing hatch (151) until a recess (150)

containing a food or beverage product (144) is adjacent to the dispensing hatch (151) and is separated from the exterior of the storage compartment by a blade (149). When the dispensing mechanism is actuated, the means for advancing the food or beverage products (144) moves the food or beverage products towards the dispensing mechanism through the agency of the force provided by the constant compression of the spring acting through the plate (154) which is in contact with the rearmost member of the stack of food or beverage products (144). Provided the storage compartment contains sufficient food or beverage products, this dispensing process will cause the dispensing mechanism to engage further food or beverage products and advance them towards the dispensing hatch, ready for dispensing.

The products may be chocolate bars which would otherwise melt in the ambient temperature, but the apparatus is applicable to other food and beverage products.

It is undesirable for the lid to be opened other than for loading with the food or beverage products because of the unwanted heat exchange (outflow of the cooled air inside the cabinet; inflow of warmer ambient air). In regular dispensing use the loss of cooled air from the storage chamber should be through the dispensing mechanism only. Measures may be taken to prevent or discourage purchasers from opening the lid and picking products out; for example a lock or catch or written notice.

The cooler cabinet shown in FIGS. 1 to 3 and described above can be used to cool, store and dispense food or beverage products in the following way. An operator loads the water-retaining material with water as previously described and activates the fan with power supplied by the power source. The storage compartment will then begin to cool. The operator then loads the storage compartment with food or beverage products. The food or beverage products may already be at a temperature lower than the ambient temperature. The continued running of the fan provides sufficient cooling to maintain the temperature of the contents of the storage compartment below the ambient temperature at the location of the cooler cabinet. The continued operation of the fan causes water to evaporate from the water-retaining material. The operator loads more water onto the water-retaining material when required, to provide the continued cooling of the storage compartment.

The invention claimed is:

1. A cooler cabinet comprising: a storage compartment for a plurality of food or beverage products; a dispensing mechanism for dispensing the plurality of food or beverage products from the storage compartment without opening the storage compartment to ambient air; a water-retaining material outside the storage compartment but in contact with it; an air channel in contact with the water-retaining material; and means for moving air through the air channel such that the air withdraws heat from the water-retaining material by evaporation of water from the water-retaining material, the evaporation, in use, causing the water-retaining material to cool, which causes the storage compartment and air within the storage compartment to cool.

2. A cooler cabinet according to claim 1 wherein the storage compartment comprises a lid and wherein at least a part of the lid is transparent.

3. A cooler cabinet according to 2 wherein the transparent part of the lid is double glazed.

4. A cooler cabinet according to claim 1 wherein the dispensing mechanism is a rotary dispensing mechanism.

5. A cooler cabinet according to claim 1 comprising a mechanism for urging the food or beverage products into the dispensing mechanism.

6. A cooler cabinet according to claim 1 wherein the water-retaining material is a water-absorbent polymer.

7. A cooler cabinet according to claim 1 wherein the water-retaining material is in contact with substantially all of a lower face of the storage compartment and at least a part of at least one side face of the storage compartment.

8. A cooler cabinet according to claim 1 wherein the water-retaining material is held in contact with the storage compartment by a support structure.

9. A cooler cabinet according to claim 8 wherein the support structure comprises a mesh.

10. A cooler cabinet according to claim 8 wherein the air channel is enclosed by the support structure and an outer casing of the cooler cabinet.

11. A cooler cabinet according to claim 1 wherein the air channel comprises an air inlet and an air outlet.

12. A cooler cabinet according to claim 1 wherein the means for moving air through the air channel is a fan.

13. A cooler cabinet according to claim 1 wherein the cooler cabinet can be operated without a mains electricity supply.

14. A cooler cabinet according to claim 13 wherein the means for moving air through the air channel is powered by a photovoltaic cell and/or an electric battery.

15. A cooler cabinet according to claim 1 wherein:

the cooler cabinet comprises an outer casing;

the storage compartment, the water retaining material and the air channel are arranged inside the outer casing; and the air channel is arranged between the water-retaining material and the outer casing.

16. A cooler cabinet according to claim 15 wherein a portion of the air channel is bounded in part by both the water retaining material and the outside casing.

17. A method of storing, cooling and dispensing a food or beverage product comprising the steps of:

(a) placing a plurality of food or beverage products in a storage compartment wherein the storage compartment is in contact with a water retaining material comprising water;

(b) moving air across the water-retaining material such that water vapor may evaporate from the water-retaining material, the evaporation causing the water-retaining material to cool, which causes the storage compartment and air within the storage compartment to cool; and (c) dispensing at least one of the plurality of the food or beverage products from the storage compartment such that the interior of the storage compartment is not exposed to ambient air.

* * * * *